United States Patent [19]

Almeraz

[11] 4,401,311

[45] Aug. 30, 1983

[54] ROLLER SKATE

[76] Inventor: Efren M. Almeraz, 3735 Findley Ave., El Paso, Tex. 79905

[21] Appl. No.: 242,237

[22] Filed: Mar. 10, 1981

[51] Int. Cl.[3] ..... A63C 17/24

[52] U.S. Cl. ..... 280/11.1 BR; 280/11.26; 280/11.28; 301/5.7

[58] Field of Search ..... 280/11.26, 11.27, 11.28, 280/11.1 BR, 87.04 A, 87.01, 87.02 R; 301/5.7, 5.3, 63 PW; 267/63 R

[56] References Cited

U.S. PATENT DOCUMENTS

| | | | |
|---|---|---|---|
| 2,717,808 | 9/1955 | Owsen et al. | 301/5.7 |
| 2,726,873 | 12/1955 | Woolley | 301/5.7 X |
| 2,732,217 | 1/1956 | Dore | 280/11.26 |

FOREIGN PATENT DOCUMENTS

| | | | |
|---|---|---|---|
| 520958 | 1/1956 | Canada | 301/5.7 |
| 21415 | 11/1910 | United Kingdom | 301/5.7 |

*Primary Examiner*—Joseph F. Peters, Jr.
*Assistant Examiner*—Michael Mar
*Attorney, Agent, or Firm*—Harvey B. Jacobson

[57] ABSTRACT

A two-piece longitudinally adjustable roller skate has a pair of support axles resiliently mounted to it. Each axis is mounted for pivotal movement about a transverse axis. The axes are downwardly converging about the middle of the skate so that pressure to one side or the other will cause the inner ends of the axles to move together, thus causing automatic turning of the skate. Each axle mounts a pair of spherical wheels. Each wheel includes an internal bearing having a single inner and a single outer race formed within the wheel. Each axle extends through an axle carrier which mounts the axle and the pair of wheels is mounted on the ends of an axle which extend out of the associated axle carrier. The bearings in the wheels abut the axle carrier and are held in place by nuts attached to the axle ends.

2 Claims, 6 Drawing Figures

ROLLER SKATE

BACKGROUND OF THE INVENTION

1. Field of the Invention

This invention relates to roller skates generally and specifically to the wheel mounting structures for roller skates.

2. Discussion of Related Art

Many types of roller skates have been suggested for use in recreational purposes. For instance, U.S. Pat. No. 521,181, issued June 12, 1894, to Riedel, shows a roller skate structure having a sole plate constructed in two parts each of which is connected to a single axle. Each axle is mounted on its ends and contains a ball-shaped wheel. U.S. Pat. No. 1,374,464, issued Apr. 12, 1921, to Nall, shows a roller skate having an axle carrier and a mount for the axle carrier which permits a torsional movement thereof so that the skater, by exerting pressure upon one side or the other of the skate, can turn the carrier so as to stear the skate. Nall's axle carrier is a unitary part stamped out of metal and has a cushion interposed between the inside pivotal support of the carrier and the body of the skate. The axles are clamped in the axle carriers and threaded to receive inner and outer ball raceway nuts which hold inner and outer raceways within each wheel. U.S. Pat. No. 2,254,450, issued Sept. 2, 1941, to Ronish, shows a roller skate having wheels each of which consists of a hub having a reduced end portion fitted snugly in axle openings of a fork. The wheel further includes a rim which mounts a cushion tire and interposed between the rim and the hub is an anti-friction bearing comprising a single inner and a single outer race. Side cover plates are carried by the rim and act to exclude dirt and foreign matter from the bearings.

SUMMARY OF THE INVENTION

One object of the present invention is to provide a roller skate having a two-piece sole plate which is longitudinally extensible to enable adjustment to fit various sized feet.

A further object of the present invention is to provide a roller skate having spherically shaped wheels which protrude on either side of the shoe of the user for wider traction thereby eliminating ankle injuries caused by tipping of the roller skate at the ankle.

An even still further object of the present invention is to provide a roller skate utilizing spherical wheels which have internal races and cones which are mounted on axles which pass through the cones.

Another still further object of the present invention is to provide a roller skate having axles and axle supports which are mounted on a resilient pad and adapted to pivot about an axis transverse to the axles so as to provide a cushion effect and automatic steering of the skates in response to a shift in weight of the skater.

In accordance with the above objects, the present invention includes a two-piece sole plate produced from a uniform thickness material throughout for uniform strength. The sole plate is stamped and formed with foot retaining structures and is adapted for longitudinal extension in order to adjust in size to accommodate various sized feet. Each piece of the sole plate includes a pair of depending flanges which are formed with vertically offset mounting apertures. A resilient mount is positioned between each pair of flanges and supports the sole plate on an axle carrier. The axle carrier includes offset protruding mounts which are pivotally received within the apertures of the flanges. Each axle carrier also has an elongated tubular portion which surrounds a solid axle having threads cut in each end. The axle protrudes from the ends of the tubular portion of the axle carrier and extends through cones which are received in spherical wheels. The cones abut the ends of the tubular portion of the axle carrier and are held thereagainst by nuts which are received on the outer threaded portions of the axle. Each cone has a race formed on the outer periphery thereof for receiving the balls of a ball bearing. The outer race of the ball bearing is formed from a pair of mated disks which are pressed to the insides of the spherical wheels. A hub cap is mounted on the outside of each spherical wheel over the nut and axle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
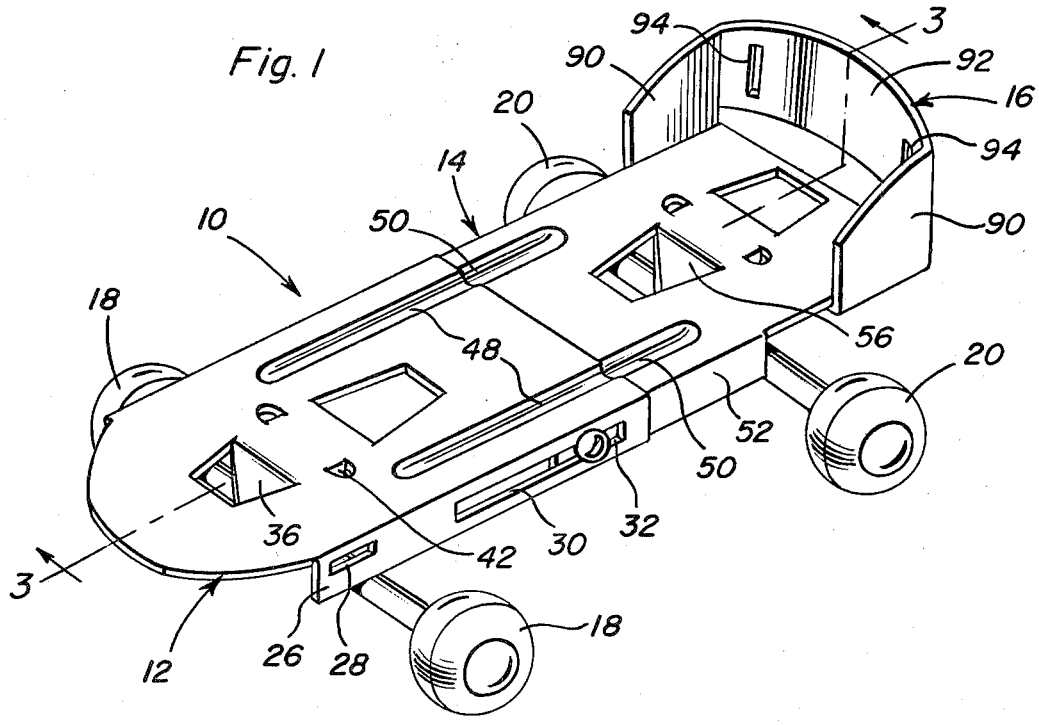
FIG. 1 is a perspective view of one roller skate of the present invention.
Figure 2:
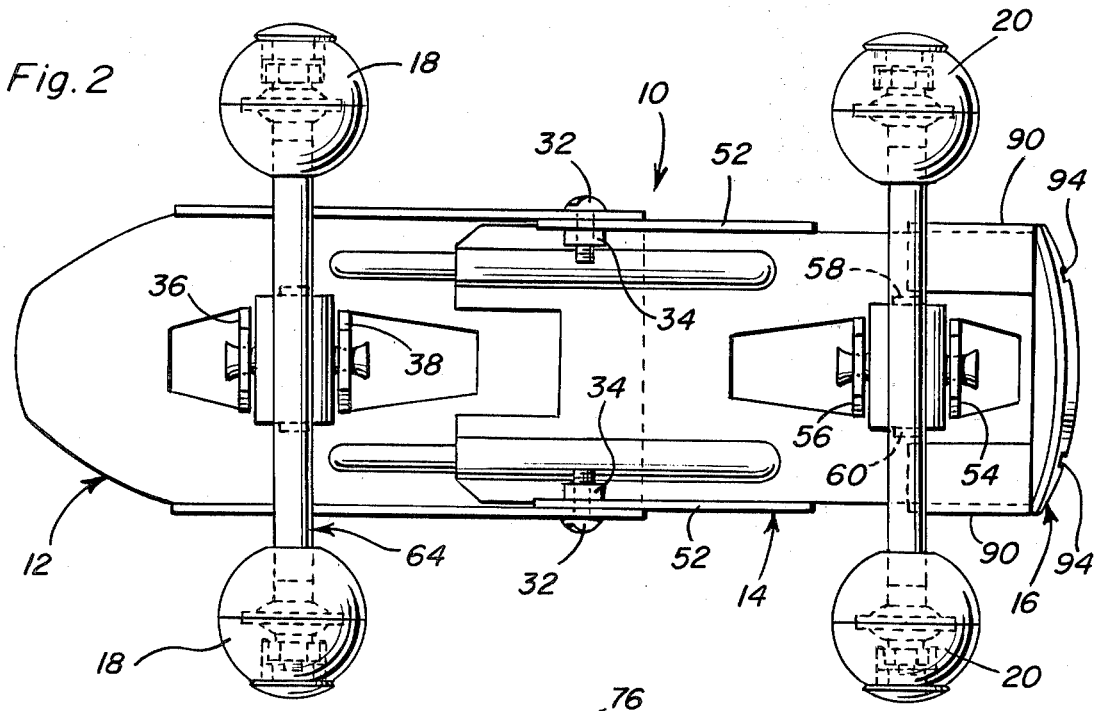
FIG. 2 is a bottom plan view of the roller skate.
Figure 6:
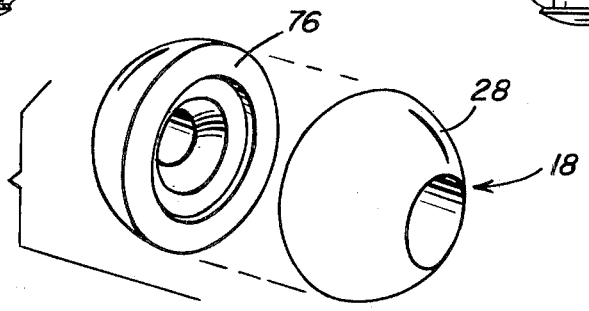
FIG. 6 is an exploded view of one spherical wheel of the present invention.
Figure 3:
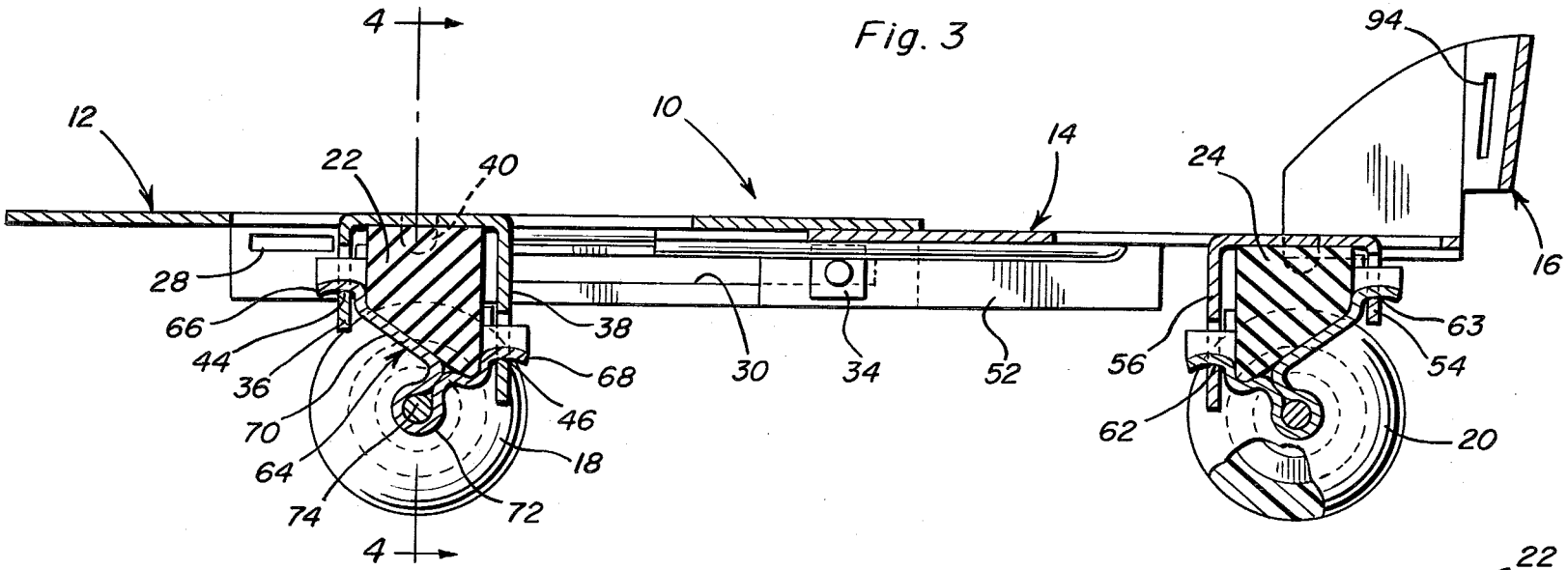
FIG. 3 is a side elevational sectional view taken substantially along a plane passing through section line 3—3 of FIG. 1.
Figure 5:
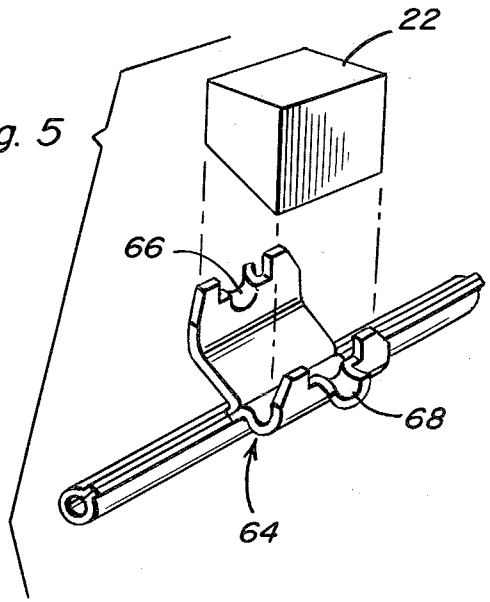
FIG. 5 is an exploded view of one axle carrier and resilient mount of the present invention.
Figure 4:
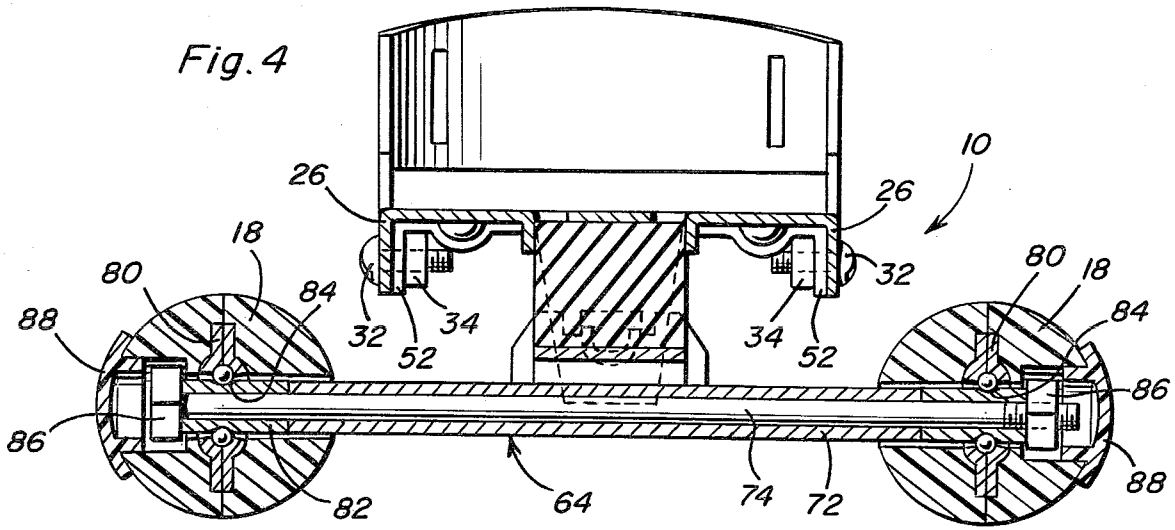
FIG. 4 is an end elevational sectional view taken substantially along a plane passing through section line 4—4 of FIG. 3.

Now with reference to the drawings, a roller skate incorporating the principles and concepts of the present invention and generally referred to by the reference numeral 10 will be described in detail. With particular reference to FIGS. 1 through 3, it will be seen that roller skate 10 comprises a two-part base plate which includes forward plate section 12 and rear base plate section 14. Each base plate section is preferably stamped from 0.65 inch metal and folded appropriately to provide retaining and interconnection sections as will be described. Connected to the rear base plate 14 is a heel retaining element 16. Both the forward and rear base plate elements are connected to and mounted upon a pair of wheels 18 and 20, respectively. Wheel pairs 18 and 20 are resiliently mounted to their respective base plates through the use of resilient mounting pads 22 and 24, respectively. Pads 22 and 24 provide a resilient cushion for the base plate as well as allow the wheels 18 and 20 to provide a steering effect to the skate in response to a change in weight distribution of the user on the base plate.

In reference to FIGS. 1 through 4, it will be seen that the forward base plate section 12 includes a substantially flat center portion attached to a pair of depending flanges 26 which can be bent downwards in the forming process. Each flange contains a forward rectangular aperture 28 which can be used for the connection of a toe strap to be mounted in a known manner for holding down the toes and forward portion of a foot of the user. Formed in each flange 26 directly behind the rectangular aperture 28 are adjustment slots 30. The adjustment slots are used in conjunction with screws and nuts 32, 34, which are mounted on the rear base plate section 14 to hold the two base plate sections together in the desired longitudinal extension. Two additional depending flanges 36 and 38 are cut from the center portion of the forward base plate section and bent downward in the forming process. The forward mounting pad 22 is positioned between these flanges and held against lateral movement by tabs 40 and 42 which are also cut from the base plate and bent downwardly. Each flange 36, 38 has a mounting aperture contained therein and labelled 44 and 46, respectively. The apertures 44 and 46 are offset in vertical height with the forward aperture 44 being positioned above the rearward aperture 46. The length of the flanges 36, 38 is sufficient to provide structural rigidity about each of the apertures and, accordingly, flange 36 is shorter than flange 38. Finally, a pair of depressions 48 are formed longitudinally of the forward base plate portion and are received in a pair of depressions 50 formed in the rear base plate section. Depressions 48 and 50 aid in maintaining proper alignment of the base plate sections when in use.

Rear base plate section 14 has a similar pair of depending flanges 52 which are positioned inwardly of flanges 26. Flanges 52 mounted the screws and nuts 32, 34 and serve to maintain the longitudinal alignment of the forward and rear base plate sections. Of course, as discussed above, larger depressions 50 are formed in the rear plate section and slidably engage the depressions 48 of the forward base plate section. A pair of depending flanges 54 and 56, similar to flanges 36 and 38, are also formed in the rear base plate section and serve to stabilize rear mounting pad 24. A pair of depending tabs 58 and 60 are also formed in the rear base plate section for providing lateral stability to the mounting pad 24. The flanges 54, 56 are positioned in a mirror image relation to flanges 36, 38. The forwardmost flange 56 of the rear base plate is the larger of the two rear flanges and contains a mounting aperture 62 in its lower portion. The shorter of the two flanges, flange 54, contains a mounting aperture 63 which is vertically spaced from aperture 62. The apertures 44, 46 and 62 and 63 form downwardly converging axes about which the axles mounting wheels 18 and 20 can pivot to produce a steering effect for the skate.

Bearing in mind that the mounting arrangement for the forward and rear wheels 18, 20, is identical except that they are mirror image, the arrangement with respect to the forward wheels 18 will be described in detail. With particular reference to FIGS. 2 through 4, 5 and 6, it will be seen that an axle carrier 64 has a U-shaped portion from which a pair of mounting lugs 66 and 68 extend and are received in the apertures 44 and 46, respectively. The base 70 of the U-shaped portion of the carrier 64 slopes downwardly from lug 66 to lug 58 and extends laterally into an integral cylindrical axle tube 72. Obviously, tube 72 can pivot about an axis which extends through the apertures 44 and 46. An axle rod 74 is permanently mounted within the tube 72 and extends outward of the ends of the tube. It will also be noted that the forward mounting pad 22 has a top surface which rests directly against the bottom of the forward base plate section, front and rear sides which extend parallel to the flanges 36, 38 and a bottom surface which slopes downwardly and rests directly against the base 70 of the axle carrier 64. Accordingly, it will be seen that the pad 22 maintains the tube 72 and axle 74 in a position which is substantially parallel to the base plate unless force is exerted on the pad to deform it. Also, it will be noted that the lugs 66, 68 are smaller in diameter than the aperture 44, 46. In this manner, space is maintained between the lugs and the apertures so that the pad 22 can act as a shock absorber for supporting the weight of a skater and absorbing bumps, and the like, which may be encountered. Mounted to each end of the axle 74 is one spherical wheel 18. Each wheel 18 is preferably formed from a urethane plastic and injection molded in two halves 76 and 78. The sphere halves are affixed to each other encompassing a bearing which comprises outer race 80 and a cone 82 which has the inner race 84 formed in its outer periphery. The cone 82 has an inner diameter sufficient to receive the axle 74 and the nuts 86 are mounted on the threaded ends of the axle to secure the wheel in place. The cone 82 has approximately the same outer diameter as the tube portion 72 of the axle carrier 64. Accordingly, when nuts 86 are tightened onto the axle 74, the cone is pressed tightly against the axle carrier thereby stationing the cones to prevent the bearings from becoming loose on the axle. The ends of the axle with the nuts 86 are recessed within the spherical wheels 18 and covered by hub caps 88. It will be noted that the wheels 18 extend laterally of the sides of the base plate in order to provide wider traction. Further, this enables the base plate to be mounted lower onto the axle to produce a lower center of gravity which greatly reduces the danger of the user being thrown forward. The use of the spherical shape for the wheels allows the wheels to provide their own centers of traction as the skater moves in any direction and eliminates edges which can be caught on cracks or other anomalies present in the skating surface. The spheres further enable a reduction of surface friction and provide for their own deflection of air currents. Accordingly, the spherical shape results in the attainment of greater speed.

The heel retaining element 16 is attached to the rear base plate section 14 by any suitable means and contains sides 90 which restrain lateral movement of the heel. A connecting plate 92 contains openings 94 which are used in conjunction with a strap which extends about the ankle of the user to hold the heel in place.

When skating, if the skater leans to the right or left, the resilient mounting pad 22, 24 are flexed thus allowing the forward and the rear axles to pivot about the downwardly converging axes, respectively. This brings the wheels on one side of the skate together, as for example if leaning to the right, the wheels 18, 20 on the right hand side of the skate are moved together while the wheels 18, 20 on the left hand side of the skate move apart. This causes the skate to turn.

It will be noted that the skate is produced with no welded parts or rivets throughout the base plate and the carriers, thus eliminating stress points which may result in fractures. There are no bolts or nuts showing at the outside of the spherical wheels which can be caught or cause injury.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a roller skate having a base plate, front and rear axle assemblies establishing parallel spaced rotational axes, resilient mounting means for connecting the base plate to each of the axle assemblies, and a pair of roller wheels mounted on each of said axle assemblies for rotation about said rotational axes, the improvement residing in each of said mounting means including parallel spaced flanges depending from the base plate perpendicular thereto and a resilient pad in abutment with the base plate between the flanges, each of said axle assemblies including an axle carrier and an axle rod on which one of said pairs of the roller wheels is mounted, the axle carrier having a U-shaped portion with lugs projecting therefrom parallel to the base plate into apertures formed in the flanges to accommodate limited pivotal motion of the axle carrier relative to the base plate and an axle tube integral with the U-shaped portion through which the axle rod extends, the U-shaped portion including a base inclined relative to the base plate and from which the axle tube extends, the resilient pad being enclosed by the U-shaped portion in abutment with the base thereof, each of said roller wheels including two hemispherical sections forming a spherical body having a diametral bore and a recess in one of the sections into which the bore opens, the other of the sections of the spherical body receiving one of the axle tubes within the bore, the axle rods in said axle tubes extending therefrom through the bores into the recesses of said spherical bodies, and a bearing assembly for each of the roller wheels, comprising a bearing sleeve mounted on the axle rod within the bore associated therewith, said bearing sleeve having an external race, assembly means mounted on the axle rod and engageable with the bearing sleeve for holding thereof in axial abutment with the axle tube, an internal race embedded within the roller wheel, and ball bearing means seated within the external and internal races for rotatably supporting the wheel on the bearing sleeve in axially overlapping relation to the axle tube and the assembly means.

2. The improvement as defined in claim 1 including a cap enclosing the assembly means within the spherical shaped body of the wheel.

* * * * *